US005839806A

United States Patent [19]

Liu

[11] Patent Number: 5,839,806

[45] Date of Patent: Nov. 24, 1998

[54] SUPPORT AND DRAWER STRUCTURE OF DRAWER TYPE STORAGE SHELF

[76] Inventor: Ching-Rong Liu, No. 10, Sung-Chiang N. Road, Chung-Li City, Taiwan

[21] Appl. No.: 865,417

[22] Filed: May 30, 1997

[51] Int. Cl.[6] ..... A47B 43/00

[52] U.S. Cl. ..... 312/257.1; 312/265.5; 312/108

[58] Field of Search ..... 312/257.1, 107, 312/108, 265.1, 265.5, 265.6, 263

[56] References Cited

U.S. PATENT DOCUMENTS

| | | | |
|---|---|---|---|
| 3,857,619 | 12/1974 | Adickes | 312/107 |
| 3,955,863 | 5/1976 | Yellin | 312/108 X |
| 4,056,295 | 11/1977 | Dowing | 312/265.1 X |
| 4,265,500 | 5/1981 | Benton et al. | 312/265.6 X |
| 4,620,684 | 11/1986 | Delpencio et al. | 312/263 X |
| 4,691,920 | 9/1987 | Neri | 312/265.5 |
| 4,777,565 | 10/1988 | McIntosh | 312/265.5 X |
| 5,176,435 | 1/1993 | Pipkens | 312/265.6 X |
| 5,639,150 | 6/1997 | Anderson et al. | 312/265.5 X |

*Primary Examiner*—Jose V. Chen
*Assistant Examiner*—James O. Hansen
*Attorney, Agent, or Firm*—Bacon & Thomas, PLLC

[57] ABSTRACT

A support and drawer structure of a drawer type storage shelf injection molded from plastic and suitable for stacking many supports and drawers thereof in layers, wherein, vertical rods are provided at the four corners of the structure and each has a protruding with an engagement piece thereon, the bottom of each vertical rod has a slipping over engagement portion with a recess being fittedly slipped over a protruding of another support and firmly connected thereto by an engagement piece and a recess and not to be scattered by loosening when the stacked supports are tipped inadvertently. Two side plates are placed on the two sides of the support for covering a drawer with a receiving bin and a panel and inserted from the front side of the support, hence the drawer can be sealed to prevent insects from invading, in the drawer, an engaging combination structure can make easy assembling and prolonged life of use.

1 Claim, 7 Drawing Sheets

SUPPORT AND DRAWER STRUCTURE OF DRAWER TYPE STORAGE SHELF

BACKGROUND OF THE INVENTION

1. Field of the Invention

The present invention relates to a support and drawer structure of a drawer type storage shelf, which structure is comprised mainly of a plurality of supports and drawers inserted in the space defined by the vertical rods of the supports and is assembled to be stacked in layers, after assembling, the whole shelf formed has the advantage of stability and good seal effect as well as prolonged life of use.

2. Description of the Prior Art

An object of a storage shelf is for convenience of assembling and use,.the basic construction thereof is as shown in FIG. 1, and is comprised of a plurality of supports and drawers 2 integrally injection mouled of plastic and piled in layers, wherein, the supports 1 each includes among others a plurality of vertical rods 11 which are positioned at the four corners of the shelf, the bottoms of the vertical rods 11 of a layer are connected with four horizontal rods 12 which form a frame; further, the top ends of the vertical rods 11 are provided at the centers thereof with protrudings 13, and the bottoms thereof are provided with grooves 14, the top end of each support 1 can support another support 1 above it, the bottom thereof can put over a third support 1 below it, stacking in this way, a drawer 2 can be placed in the space defined by the vertical rods 11 of a support 1 on a layer and is supported by four horizontal rods 12, when in use, the drawer 2 can be drawn out for receiving therein clothes or other articles.

The above stated conventional drawer type storage shelf has the advantage of stacking in layers as desired, however, it has the defect of unability of sealing, insects such as cockroaches may invade easily, moreover, the stacking structure of the conventional drawer type storage shelf is not stable, when the drawers are drawn out, shaking will be incurred, especially when a shelf is tipped inadvertently, the vertical rods 11 in every layer will drop and be scattered, awful inconvenience can be induced to a user. Besides, the drawers 2 are integrately injection mouled, when they are shaped, the front edges of the tops thereof are firstly extended forwardly and then bended back to form pulling edges 21, when the drawers 2 are filled with articles, pulling force exerted by the user on a pulling edge 21 will be completely absorbed by the thinner front edge of the drawers 2, therefore, the pulling edge 21 is subjected to damage.

SUMMARY OF THE INVENTION

In view of this, the inventor of the present invention provides a support and drawer structure of a drawer type storage-shelf based on his professional experience of years in manufacturing and selling various plastic storage bins and after continuous study and improving, for eliminating disadvantage resided in the prior art.

Particularly, in the support and drawer structure of the drawer type storage shelf of the present invention:

The main body of a support is integrally injection moulded from plastic, it is comprised of a plurality of vertical rods, horizontal rods, a bracing rod, a backing plate and two side plates; wherein, the vertical rods are provided respectively at the four corners of the main body and each is provided with a protruding with a smaller diameter on the top thereof, and an engagement piece is provided on each protruding; the bottom of each vertical rod is provided with a slipping over engagement portion having an inner diameter just the same as the exterior diameter of the protruding, and thereby the slipping over engagement portion is fittedly slipped over a protruding of another support, the slipping over engagement portion has a recess being conformed with the engagement piece, the recess and the engagement piece are for fixed engaging; the inner opposite sides of the vertical rods located in the front and at the rear of the support each is provided with a protruding locating sheet of flange. The horizontal rods transverse and longitudinal horizontal rods are provided to form a bottom frame of the main body, and are connected each between two vertical rods, the external sides of the two transverse horizontal rods are flush with the locating sheets in vertical planes and each is provided with an engaging portion. The backing plate is connected between the rear vertical rods. The bracing rod is provided on the bottom for connecting the longitudinal horizontal rods. The above mentioned side plates are in the shape of sheets and are placed between the vertical rods on the two sides of the support, and are abutted on the locating sheets at both ends thereof and the external sides of the two transverse horizontal rods, and are provided with engaging hooks on the ends thereof abutting on the locating flanges, and further are provided on the surfaces thereof at the positions corresponding to the engaging portions mentioned above with engaging members, by engaging of the engaging hooks and the engaging members with the locating flange and the engaging portions respectively, the side plates are fixed between the vertical rods on the two sides of the support, so that the two sides of the support are in sealed state.

The center of the drawers is a receiving space for receiving clothes, documents etc., their size is exctly for their fitting in the space defined by the vertical rods, and they are supported by the horizontal rods and the bracing rods; the front panels of the drawers have on their bottoms handles for an action force to draw out or pull in the drawers; the front panels can be formed integrately with the receiving bins of the drawers, or can be assembled in combination therewith.

By providing the above stated structure, when a drawer is drawn out, it can be filled with articles, when it is placed into a support, a sealed space can be formed by defining of the side plates and the backing plate on both sides and on the rear thereof as well as the front panel, so that insects can be prevented from invading; moreover, when the protrudings on the tops of the vertical rods of a support are inserted into the slipping over engagement portions on the bottoms of the vertical rods of another support, by engagement of the recesses and the engagement pieces mentioned above, the supports stacked one over another can form a firm structure, it will not be loosened to be scattered when the stacked supports are tipped by inadvertent collision.

The object of the present invention thus is to provide a support and drawer structure of a drawer type storage shelf, such structure can have the effect of firm connection and effective sealing.

The present invention will be apparent after reading the detailed description of the preferred embodiment thereof in reference to the accompanying drawings.

DETAILED DESCRIPTION OF THE PREFERRED EMBODIMENT

Figure 1:
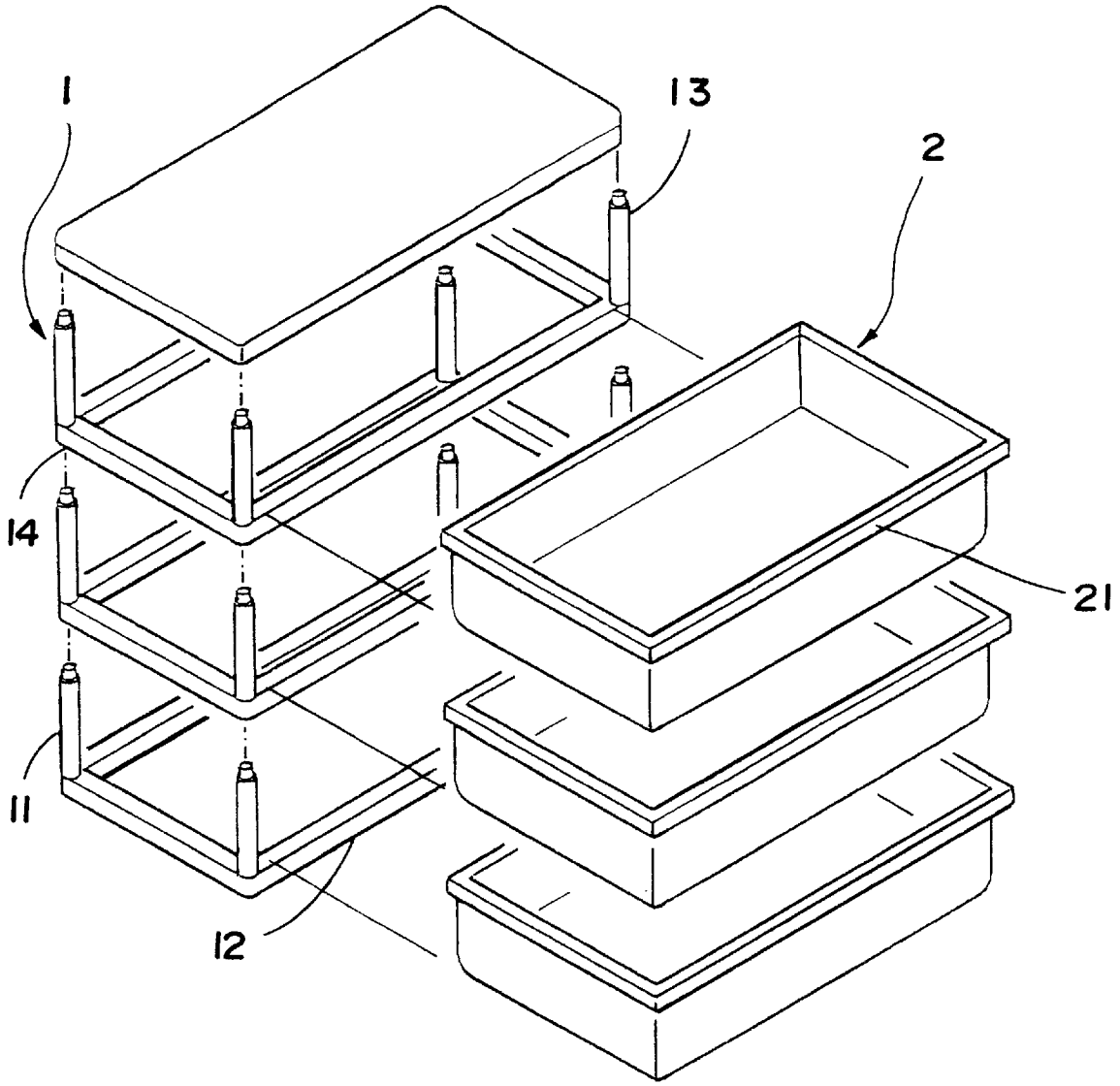
FIG. 1 PRIOR ART
FIG. 1 an antomic perspective view of a conventional drawer type storage shelf.
Figure 2:
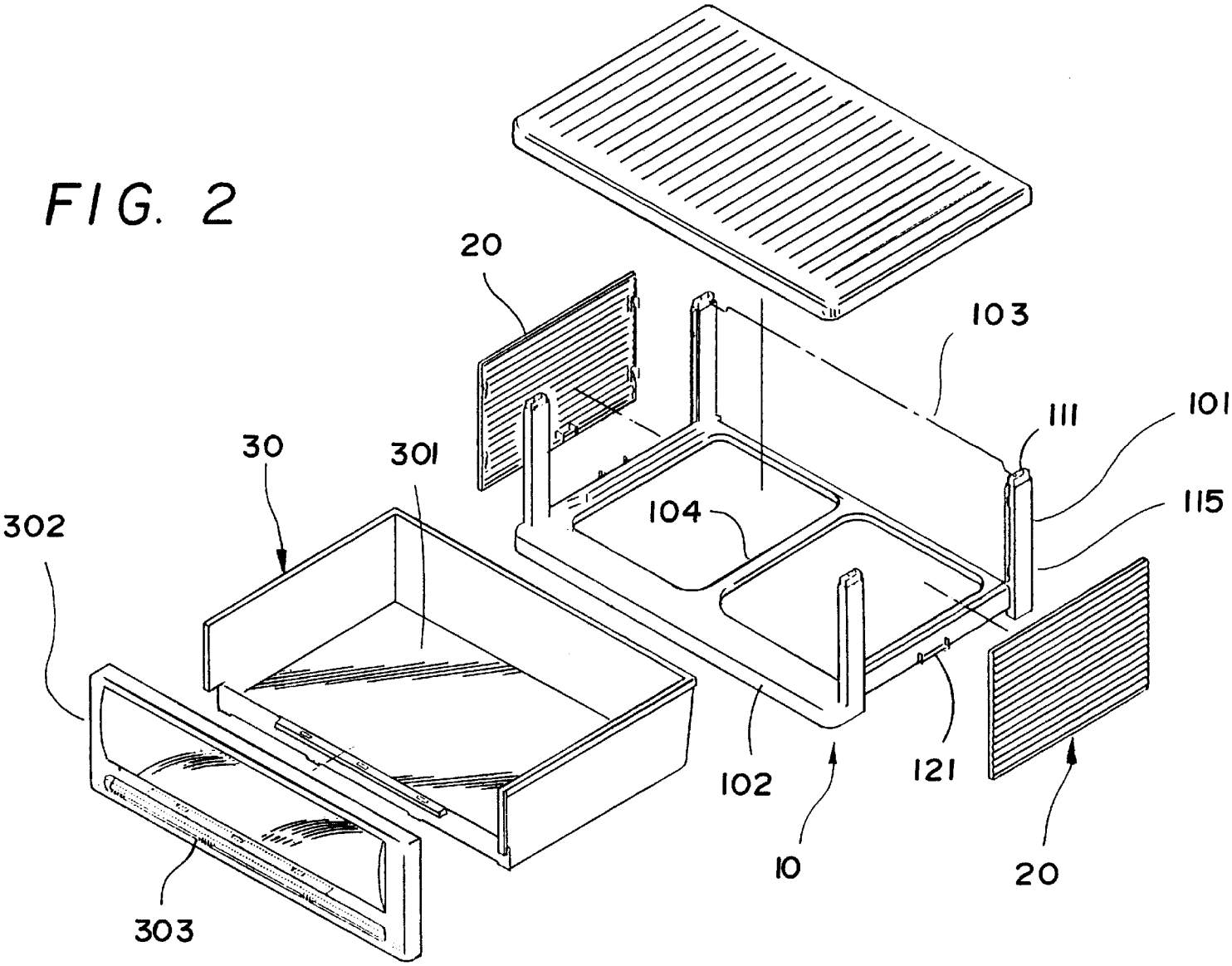
FIG. 2 is a perspective view of the present invention.
Figure 3:
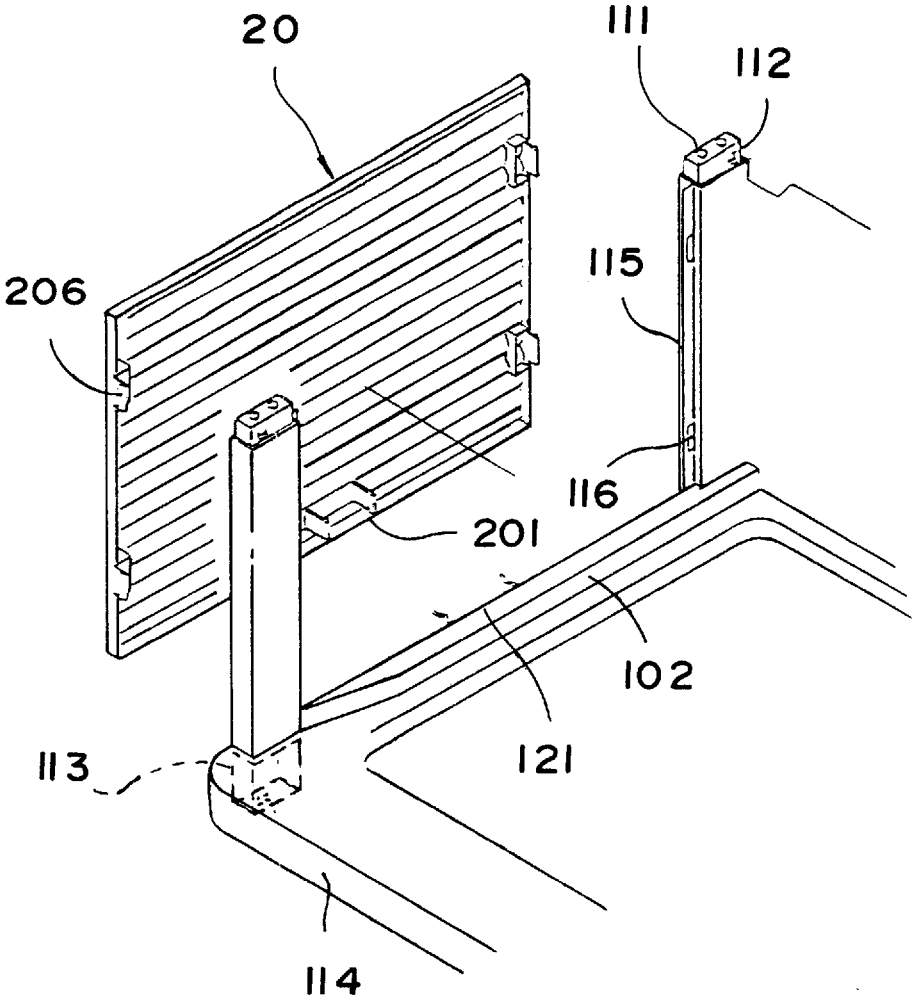
FIG. 3 is a view showing the relationship between the side plates and the support of the present invention.
Figure 4:
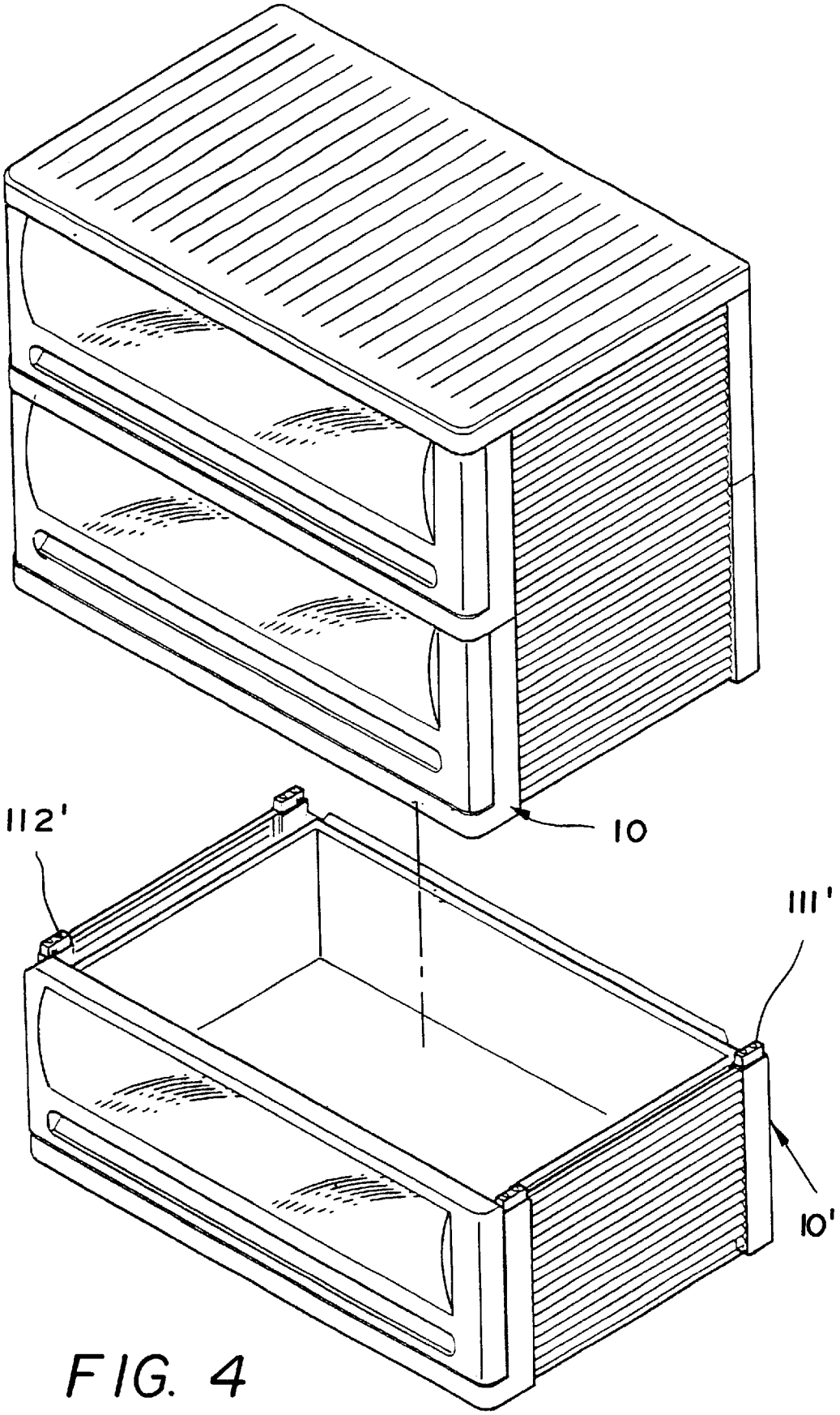
FIG. 4 is a schematic view showing stacking of a plurality of supports of the present invention.

Referring to FIG. 2 of the drawings, in the support and drawer structure of the drawer type storage shelf of the present invention:

The main body of the support 10 is formed integrally by injection moulding, and is consisted of a plurality of vertical rods 101, horizontal rods 102, a backing plate 103 and a bracing rod 104; a side plate 20 is provided at each side thereof. Wherein, the vertical rods 101 are provided upright at the four corners of the support 10, a protruding 111 of slightly smaller diameter is provided on the top of each vertical rod 101 and is provided on the external edge thereof with an engagement piece 112 (FIG. 3); the bottom of the vertical rod has a slipping over engagement portion 113 having an inner diameter just the same as the exterior diameter of the protruding 111, and thereby the slipping over engagement portion 113 is fittedly slipped over a protruding 111' of another support 10' (FIG. 4), the slipping over engagement portion 113 has a recess 114 being conformed with the engagement piece 112, by engagement of the recess 114 and the engagement piece 112' on the other support 10', the two supports 10, 10' can be connected with each other in an upper and lower position relationship. Further, the inner opposite sides of the front and the rear vertical rods 101 on the support 10 each is provided with a protruding locating sheet or flange 115 which is further provided with a plurality of locating holes 116.

The horizontal rods 102 of the support 10 are transverse and longitudinal horizontal rods provided to form a bottom frame, and are connected each between two vertical rods 101 for securing of the latter, the external sides of the two transverse horizontal rods 102 are flush with the locating flanges 115 in vertical planes and each is provided with an engaging portion 121. The lateral ends of the backing plate 103 of the support 10 is connected to and between the rear vertical rods 101, while the bottom of the backing plate 103 is connected to a corresponding longitudinal horizontal rod. The bracing rod 104 of the support 10 is provided for connecting the longitudinal horizontal rods 102.

Figure 5A:
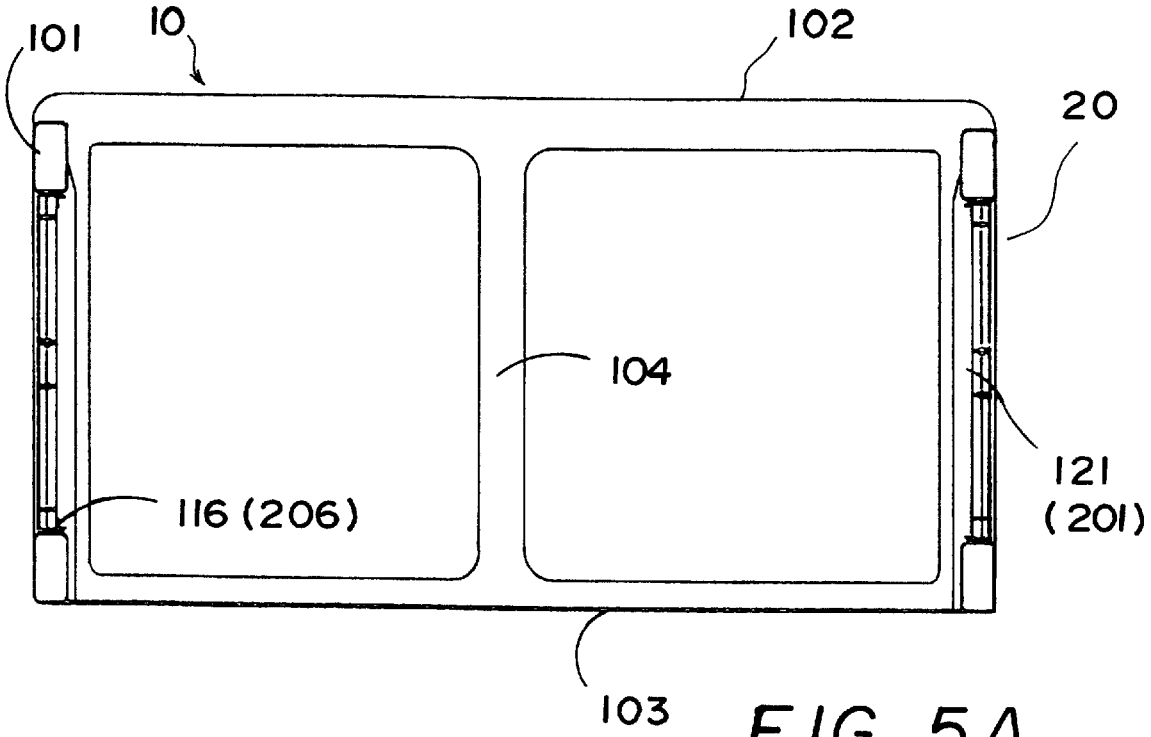
FIG. 5 is a sectional view showing assembling of the side plates and the support of the present invention.
Figure 5:
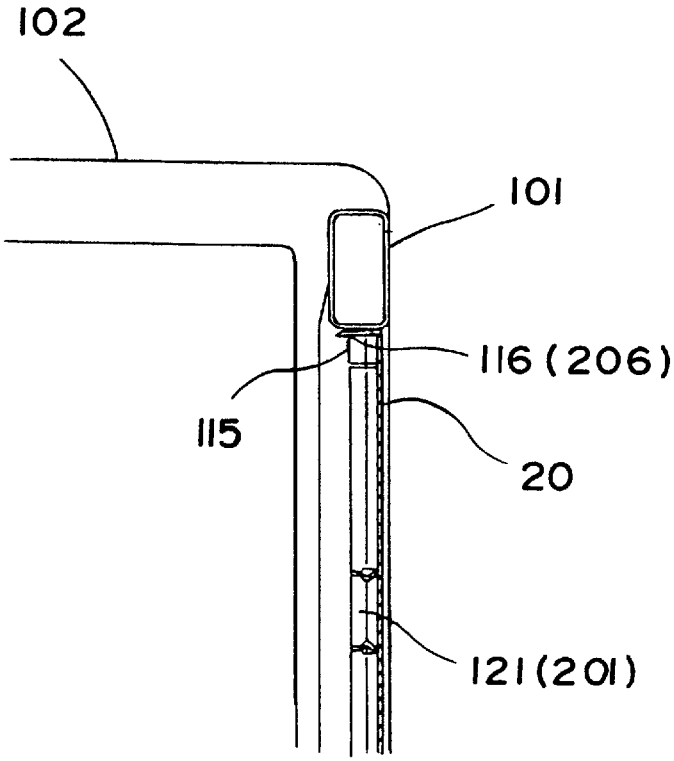

The above mentioned side plates 20 are placed between the vertical rods 101 on the two sides of the support 10 (FIG. 3) and are in the shape of sheets, and are abutted with the locating flanges 115 on the vertical rods 101 at both ends thereof and abutted with the external sides of the two transverse horizontal rods 102, and are provided with engaging hooks 206 on the ends thereof opposite to the locating holes 116 on the locating flanges 115, and further are provided on the surfaces thereof at the positions corresponding to the engaging portions 121 of the transverse horizontal rods 102 with engaging members 201, when the side plates 20 are placed on the two sides of the support 10 respectively (FIG. 5), they will seal the two sides of the support 10, and by engaging of the engaging hooks 206 and the engaging members 201 with the locating holes 116 on the vertical rods 101 and the engaging portions 121 of the transverse horizontal rods 102 respectively, the side plates 20 are fixed between the vertical rods 101 on the two sides of the support.

By providing the above stated structure, it can be seen that the support and drawer structure of the drawer type storage shelf of the present invention has the advantage stated below:

1. firmness of structure: The supports 10, 10' stacked one over another can form a firm structure because the fact that, the slipping over engagement portions 113 of the vertical rods 101 are slipped over the protrudings 111' on the top of vertical rods of another support 10', by emgagement of the recesses 114 on the engagement portions 113 with the engagement pieces 112' on the protrudings 111', the structure after stacking will not be loosened to be scattered when the stacked supports 10, 10' are tipped by inadvertent collision.
2. sealing effect: The supports 10, 10' each has side plates 20 and a rear backing plate 103, so that when a drawer 30 is received in the support 10 (10'), the contents received therein can be appropriately sealed and protected, no problem of cockroaches invading or dust contamination will be incurred.
3. easiness of assemblig: When the supports 10, 10' are stacked one over another, they can-get the effect of firmness still only being assembled in the way the same as the conventional way, i.e., by only stacking one over another, they can be fixedly engaged with one another; in assembling the side plates 20 and the supports 10, 10', engagement thereof can be completed only by abutting the side-plates 20 on the locating sheets 115 and pressing, thereby, the effect of easiness of assemblig can be achieved.

Figure 6:
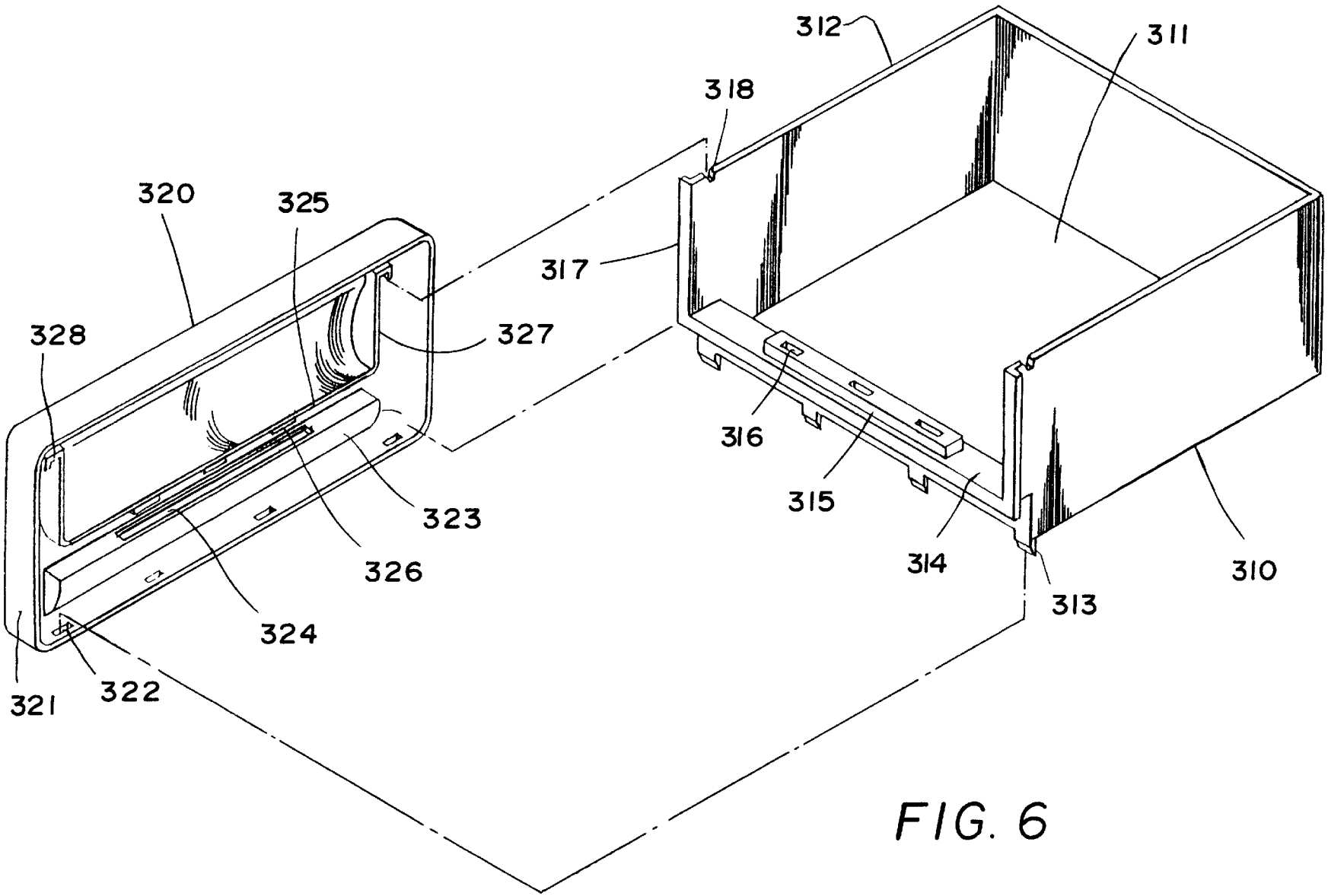
FIG. 6 is an anatomic perspective view of a drawer of the present invention.
Figure 7:
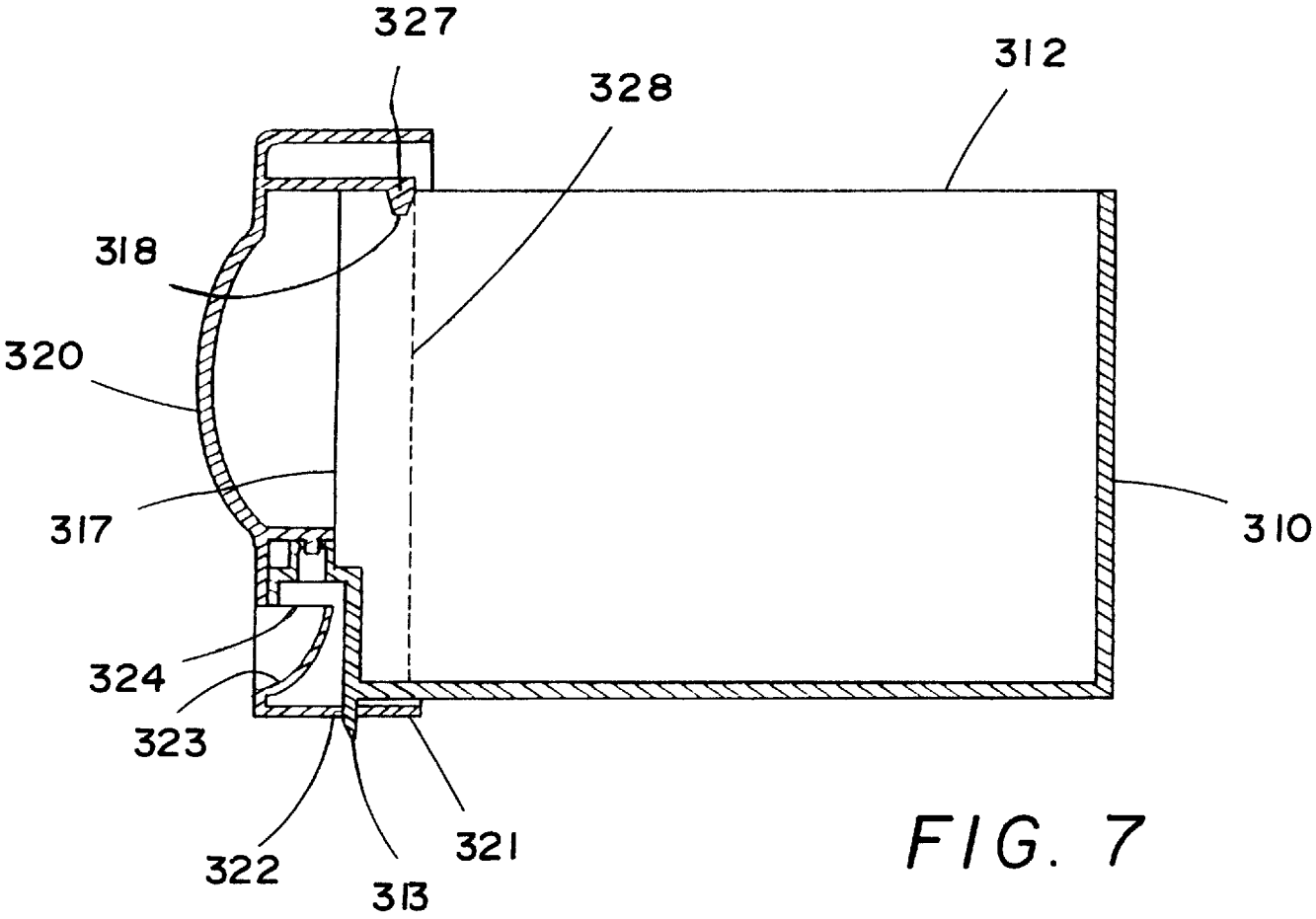
FIG. 7 is a sectional side view of a drawer of the present invention.

The above mentioned drawer 30 can be integrately injection molded, or can be assembled by using a panel and a receiving bin. FIG. 6 shows an embodiment of it in assembling, it is comprised of a receiving bin 310 integrately jection molded from plastic and a panel 320, wherein:

The receiving bin 310 is comprised of a horizontal bottom plate 311, two vertical side plates 312 and a backing plate, the front end thereof is opened, a plurality of protruding engaging strips 313 are extended down from the bottom thereof and intermitently distributed, a holding edge 314 is provided on the front edge of the bottom and extended frontwardly, the holding edge 314 is provided at the middle thereof with a hollow handle 315 which is formed by partially raising upwardly of said holding edge 314 and is provided with a plurality of engaging holes 316; the two side plates 312 of the receiving bin 310 further are provided with two connecting edges 317 extending forwardly therefrom, the bottoms of the connecting edges 317 are combined respectively with the two sides of the holding edge 314 while the tops thereof are provided with two engaging recesses 318 at the junction thereof with the two side plates 312.

The aforementioned panel 320 is in the form of a sheet and can be assembled on the front edge of the receiving bin 310, four rims 321 are extended backwardly from the four edges of the panel 320 respectively, the bottom rim 321 is provided with a plurality of engaging holes 322 which correspond to the engaging strips 313 of the receiving bin 310, the panel 320 is provided with a groove 323 which protrudes inwardly from the front face of the panel 320 and is located exactly below the holding edge 314 of the receiving bin 310 after the panel 320 is assembled with the receiving bin 310, the groove 323 further is provided with an opening 324 correspond in position to the hollow handle 315, a user can put his hand from outside into the groove 323 of the panel 320 to grasp the handle 315 through the opening 324; besides, the inside surface of the panel 320 is provided with an engaging edge 325 which is located exactly above the groove 323 and thus is above the handle 315 after assembling and is provided with a plurality of engaging members 326 corresponding to the engaging holes 316 provided on the top of the handle 315, both sides of the engaging edge 325 are extended upwardly to form abutting edges 327 capable of fittedly abutting on the connecting edges 317 on the two sides of the front end of the receiving bin 310, the tops of the abutting edges 327 are provided with two engaging hooks 328 which can be engaged in the engaging recesses 318.

By providing the above stated structure, when the panel 320 is connected with the receiving bin 310, the engaging holes 322 which is provided on-the bottom rim 321 of the panel 320 is engaged by the protruding engaging strips 313 on the bottom of the front end of the receiving bin 310; and the engaging members 326 on the engaging edge 325 of the panel 320 near the bottom of the panel 320 are engaged in the engaging holes 316 on the handle 315 of the receiving bin 310; moreover, the engaging hooks 328 near the top of the panel 320 are engaged in the engaging recesses 318, so that fixed connecting can be effected; besides, there are abutting edges 327 on the two sides of the panel 320 to abut on the connecting edges 317 of the receiving bin 310, firmness of connecting can thereby be enforced, effect of firmness thus is obtained. Further, when in assembling of the above stated structure, force is only required to exert on the panel 320 to render it to get close to the receiving bin 310 for assembling, so that the effect of easiness of assembling can be achieved. And more, when in use, a user can put his hand into the groove 323 of the panel 320 to grasp the handle 315 on the receiving bin 310 through the opening 324, the handle 315 bears the action force and distribute the force to the whole front edge of the receiving bin 310 through the above stated engaging structure, so that the handle 315 is not subjected to damage, and an object of prolonging of life of use can be achieved.

Having thus described my invention, what I claim as new and desire to be secured by letters patent of the United States is:

1. A support structure of a drawer type storage shelf, comprising:

a main body integrally injection molded from plastic formed by a plurality of vertical rods and horizontal rods, a backing plate and a bracing rod, said main body having a front, a rear and two sides, said horizontal rods being longitudinal and transverse horizontal rods forming a bottom frame of said main body with four corners, said vertical rods being provided at said four corners of said bottom frame;

said vertical rods each including a top having a protruding with a slightly smaller diameter and an engagement piece on an exterior surface of said protruding and each including a bottom having a slipping over engagement portion and a recess conforming with said engagement piece, said slipping over engagement portion being fittedly slippable over a protruding of another support;

said vertical rods each including a protruding locating flange on an inner opposite side thereof such that said locating flanges of said vertical rods located at said front of said main body extend rearward and said locating flanges of said vertical rods located at said rear of said main body extend forward, said located flanges each having a plurality of locating holes;

said transverse horizonal rods each having an engaging portion provided on an external side thereof at a lower edge of said locating flanges;

said backing plate being connected between said vertical rods located at said rear of said main body and said bracing rod being connected between said longitudinal horizontal rods; and two side plates each having an interior surface defined by a top edge, a bottom edge and two side edges, each of said side plates having a plurality of engaging hooks on said inner surface near said side edges and an engaging member on said inner surface near said bottom edge, said engaging hooks and said engaging members being positioned to correspond to said locating holes and said engaging portions, respectively, such that said engaging hooks engage said locating holes, said engaging members engage said engaging portions and said side plates are fixed between said vertical rods when said side plates are placed on said sides of said main body.

* * * * *